US005273711A

United States Patent [19]

Nachtrab et al.

[11] Patent Number: 5,273,711

[45] Date of Patent: Dec. 28, 1993

[54] HIGH STRENGTH AND DUCTILE DEPLETED URANIUM ALLOY

[75] Inventors: William T. Nachtrab, Maynard; Nancy F. Levoy, Acton, both of Mass.

[73] Assignee: Nuclear Metals, Inc., Concord, Mass.

[21] Appl. No.: 772,848

[22] Filed: Oct. 8, 1991

[51] Int. Cl.[5] ..... C22C 43/00

[52] U.S. Cl. ..... 420/3; 102/501; 102/517

[58] Field of Search ..... 420/3; 102/501, 517

[56] References Cited

U.S. PATENT DOCUMENTS 4,383,853 5/1983 Zapffe ..... 420/3

4,650,518 3/1987 Arntzen et al. ..... 420/3

*Primary Examiner*—Stephen J. Lechert, Jr.

*Attorney, Agent, or Firm*—Iandiorio & Dingman

[57] ABSTRACT

A high strength and ductile depleted uranium alloy including two or three alloying elements, two of which are molybdenum and titanium, in which the total weight percent of all of the alloying elements makes up no more than 2% of the alloy weight, in which there is from 0.75 to 1.50 weight % molybdenum, and 0.30 to 0.70 weight % titanium.

16 Claims, No Drawings

HIGH STRENGTH AND DUCTILE DEPLETED URANIUM ALLOY

FIELD OF INVENTION

This invention relates to a depleted uranium alloy having both high strength and high ductility that is particularly suited for the fabrication of kinetic energy penetrators.

BACKGROUND OF INVENTION

Depleted uranium is an extremely dense metal that has been used for years as the primary constituent of kinetic energy penetrators. Depleted uranium itself has a ductility of approximately 8–22% and a relatively low tensile strength of 67–102 ksi; rolled and heat-treated depleted uranium has 12–49% elongation and a tensile strength of 83–109 ksi. The requirements for a successful penetrator, however, call for a material having significantly higher strength to assist penetration in addition to a density greater than 18 gm/cc to provide a maximum amount of kinetic energy, and high ductility so the penetrator will not bend or shatter on impact. Accordingly, uranium alloys have been used for penetrators.

There has been some effort made to modify the mechanical properties of uranium to improve its strength while maintaining sufficient ductility. Heat treatment, alloying and thermomechanical processing techniques have been used to improve the strength of depleted uranium. Metallurgical approaches to strengthening that have been shown to be operative in uranium include grain refinement, substructure refinement, strain hardening, precipitation strengthening and dispersion strengthening. The alloying elements that have been studied in uranium metallurgy include molybdenum, niobium, titanium and zirconium.

Perhaps the most commonly used alloy for penetrators is U-0.75 weight % Ti. It has been found that uranium-titanium alloys having about 0.6% to 0.8% titanium with appropriate heat treatment have a two-phase room temperature microstructure of alpha' uranium plus $U_2Ti$. The alloy in this condition has a yield strength of approximately 123 ksi (thousands of pounds per square inch), a tensile strength of approximately 200 ksi, and an elongation of 24%: for penetrator design, approximately 10% elongation is required. After peak aging treatment, the maximum yield strength is about 200 ksi, the tensile strength is about 215 ksi, but the elongation only 2%. Accordingly, the U-0.75% Ti alloy with sufficient ductility for penetrator use has a yield strength of well under 200 ksi.

In heat treating the U-0.75% Ti alloy, proper control of the quench rate is required in order to provide the proper mode of transformation that occurs upon cooling from the solutionizing temperature to room temperature. To achieve the desired 100% martensitic structure, in which the gamma to alpha transformation is suppressed and the gamma phase transforms directly to the desired alpha' acicular martensitic structure, the U-0.75% Ti alloy must be quenched at approximately 100° centigrade per second from the approximately 800° C. temperature of the gamma phase to room temperature. To achieve this quench rate, a combination of a water quench process and alloy section sizes of less than approximately 3 centimeters is required. Accordingly, the U-0.75% Ti cannot effectively be heat treated in section sizes greater than 3 centimeters and still achieve the required strength and ductility.

In general, as alloy content is increased, the martensite start transformation temperature of the alloy decreases, resulting in an increased quench rate sensitivity. This effect is very pronounced for molybdenum additions, and less pronounced for titanium additions. Accordingly, the overall effect of alloy content on quench rate sensitivity is a balance between the undesired suppression of the martensite start temperature and the retardation of diffusional transformations.

The U-0.75% Ti alloy is typically aged to increase strength and hardness at the expense of ductility. Strengthening is typically accomplished by aging in the temperature range 350° C. to 450° C., which results in precipitation strengthening without a large amount of cellular decomposition of the acicular martensite to the equilibrium alpha and $U_2Ti$ phases. To achieve the best combination of strength and ductility in the U-0.75% Ti alloy, an underaging treatment of four to six hours at 380° C. is most commonly used, producing an alloy with a yield strength on the order of 130 ksi and a ductility of over 10%.

Another uranium alloy, U-2 weight % Mo, exhibits highest ductility when processed in the overaged condition. For example, yield strengths of up to 130 ksi with ductility of over 10% can be achieved. However, for yield strengths greater than 130 ksi, ductility is extremely low as the alloy must be processed in the underaged or peak aged conditions. For example, at peak aged condition the yield strength is about 210 ksi, but the elongation is only about 1%.

A number of polynary uranium alloys have also been previously studied. Such alloys can be solutionized, quenched and age hardened in a manner similar to that for the U-0.75% Ti and U-2% Mo. However, these polynary alloys typically have a total alloy content of much greater than 2%, resulting in banded alpha" martensitic as-quenched structures that can be aged to high strength, but have very high quench rate sensitivity, low ductility, and increasingly lower density as the alloy content is increased. These alloys also have densities less than 18 g/cc, making them unsuitable for KE penetrator use. Accordingly, the known polynary uranium alloys do not have the combination of density, strength, quench rate sensitivity and ductility properties required for use as penetrators.

SUMMARY OF INVENTION

It is therefore an object of this invention to provide a depleted uranium alloy that has increased strength while maintaining sufficient ductility for use in penetrators.

It is a further object of this invention to provide such an alloy that can be used to make relatively thick structures.

It is a further object of this invention to provide such an alloy that has decreased quench rate sensitivity.

It is a further object of this invention to provide such an alloy that has relatively fine grain size.

It is a further object of this invention to provide such an alloy that has sufficient density for use in penetrators.

It is a further object of this invention to provide such an alloy that has approximately 10% elongation, a yield strength of approximately 200 ksi or greater, and a tensile strength of approximately 260 ksi or greater.

This invention results from the realization that a high strength and ductile depleted uranium alloy that has greatly improved strength characteristics while maintaining sufficient ductility for penetrator use may be accomplished by alloying the uranium with a combination of molybdenum and titanium that together make up less than 2% of the total alloy weight.

This invention may suitably comprise a high strength and ductile depleted uranium alloy comprising approximately 0.75 to 1.50 weight % molybdenum, approximately 0.30 to 0.70 weight % titanium, and depleted uranium. Preferably, the alloying elements other than depleted uranium make up no more than approximately 2% of the total alloy weight. In some embodiments, there may be included a third alloying element taken from the group including zirconium, hafnium, vanadium, chromium, niobium, tantalum and tungsten. This third element may make up approximately 0.05 to 0.5 weight % of the alloy. In a preferred embodiment, the third element is zirconium comprising approximately 0.15 to 0.30 weight % of the alloy. In the embodiment in which the third alloying element is niobium, the niobium may make up no more than approximately 0.5 weight % of the alloy. The alloy of this invention preferably has a yield strength of at least approximately 180 ksi, a tensile strength of at least approximately 250 ksi, an elongation of at least approximately 8%, and a density of at least 18 g/cc.

DISCLOSURE OF PREFERRED EMBODIMENTS

Other objects, features and advantages will occur to those skilled in the art from the following description of preferred embodiments.

This invention may be accomplished with a high strength and ductile depleted uranium alloy that preferably includes 2% or less in total of a combination of molybdenum, titanium and another alloying element taken from the group including zirconium, hafnium, vanadium, chromium, niobium, tantalum, and tungsten.

Uranium alloys can be strengthened by a combination of solid solution strengthening, precipitation hardening, substructure strengthening, dislocation strengthening, dispersion strengthening and texture strengthening. In these alloys, increasing the alloy content to achieve higher strength and retard the onset of diffusional decomposition conversely causes the martensite start temperature to be lowered, resulting in greater quench rate sensitivity, which limits the size (diameter) of structures that can be made from the alloy. In addition, large alloy contents lower the alloy density and result in a change in both alloy microstructure and crystal structure. Thus, density, quench rate sensitivity, and changes in microstructure and crystal structure must all be considered in designing a depleted uranium alloy for high strength and ductility.

To increase strengthening, it is desirable to increase the alloy content. To minimize quench rate sensitivity, however, the alloy should have a relatively high martensite start temperature, which requires a low alloy content. It has been found, however, that a combination of two or more alloying elements within defined concentrations with a total alloy content within defined limits will accomplish a balance of the interactions and effects of the individual alloying elements to minimize lattice strain so that the martensite start temperature is not greatly depressed in order to minimize quench rate sensitivity, while still maintaining an alpha' phase product that has the desired hardness. In addition, proper selection of alloy components enhances precipitation strengthening and produces grain refinement, leading to both increased strength and the maintenance of sufficiently high ductility for KE penetrator use.

Uranium alloys possessing these properties resulting in alloys having elongations in the range of approximately 10% or more, and tensile yield strengths in the range of 180 ksi and up, may be accomplished by alloying the uranium with molybdenum and titanium that together contribute no more than approximately 2 weight percent of the alloy. More specifically, there may be about 0.75 to 1.50 weight % molybdenum and about 0.30 to 0.70 weight % Ti. Alloys with these compositions have the desired properties for up to about 1.5 cm section sizes. Another alloying element taken from group IVA, VA or VIA elements such as chromium, vanadium, niobium, tungsten, tantalum, zirconium and hafnium may be added as a third alloying element to further refine the grain and/or optimize the alloy for TMP treatment. The third element is preferably from 0.05 to 0.5 weight % of the total. If zirconium, it may be 0.15 to 0.30%. If niobium, no more than 0.5%. Alloys with a third element have the desired properties for larger section sizes at least up to about 3 cm. The total alloying element content of less than 2% also maintains a density greater than 18 g/cc as required for KE penetrators.

The following are examples of five alloys made in accordance with the subject invention:

EXAMPLE I 90.24 kg depleted uranium, 687.1 grams molybdenum, 458.1 grams titanium, and 229.1 grams zirconium were placed in a graphite crucible and melted in a vacuum induction furnace. The molten metal was poured into an 11.4 cm cylindrical mold, cooled to room temperature, and removed from the mold. The resulting ingot was placed in a copper can, which was then evacuated and sealed. This billet was then extruded at 670° C. through a 2.9 cm die. The extruded rod was cut into pieces approximately 61 cm in length, which were then ground for removal of the copper can to 2.8 cm diameter. A section of this extruded rod was outgassed 2 hours at 850° C. in a vacuum furnace, cooled to room temperature, then induction solutionized several minutes at 900° C. and water quenched. The rod was then given an aging heat treatment in a vacuum furnace for 4 hours at 380° C. Tensile properties for the resulting material, having a nominal composition of U-0.75%Mo-0.5%Ti-0.25%Zr, were measured at 206 ksi tensile yield strength, 270 ksi ultimate tensile strength, and 9.7% elongation.

EXAMPLE II 90.02 kg depleted uranium, 916.3 grams molybdenum, 458.1 grams titanium, and 229.1 grams zirconium were placed in a graphite crucible and melted in a vacuum induction furnace. The molten metal was poured into an 11.4 cm cylindrical mold, cooled to room temperature, and removed from the mold. The resulting ingot was placed in a copper can, which was then evacuated and sealed. This billet was then extruded at 670° C. through a 3.2 cm die. The extruded rod was cut into pieces 40–46 cm long, which were then ground for removal of the copper can to 2.8 cm diameter. A section of this extruded rod was outgassed 2 hours at 850° C. in a vacuum furnace, cooled to room temperature, then induction solutionized several minutes at 900° C. and water quenched. Tensile properties for the resulting material in the solution treated condition, having a nominal composition of U-1.0% Mo-0.5% Ti-0.25% Zr, were measured at 183 ksi tensile yield strength, 260 ksi ultimate tensile strength, and 16% elongation.

EXAMPLE III

A rod prepared as described in Example II was aged in a vacuum furnace for 4 hours at 380° C. Tensile properties for this material were measured at 212 ksi tensile yield strength, 274 ksi ultimate tensile strength, and 10% elongation.

EXAMPLE IV 83.79 kg depleted uranium, 916.1 grams molybdenum, 458.1 grams titanium, and 6.45 kg of uranium-7.1 wt % niobium alloy were placed in a graphite crucible and melted in a vacuum induction furnace. The molten metal was poured into an 11.4 cm cylindrical mold, cooled to room temperature, and removed from the mold. The resulting ingot was placed in a copper can, which was then evacuated and sealed. This billet was then extruded at 670° C. through a 3.2 cm die. The extruded rod was cut into pieces approximately 40 cm in length, which were then ground for removal of the copper can to approximately 2.8 cm diameter. A section of this extruded rod was given a one step outgassing and solutionizing treatment in a vacuum furnace for 2 hours at 850° C., then water quenched. The rod was then given an aging heat treatment in a vacuum furnace for 4 hours at 380° C. Tensile properties for the resulting material, having a nominal composition of U-1%Mo-0.5%Ti-0.5%Nb, were measured at 213 ksi tensile yield strength, 260 ksi ultimate tensile strength, and 8.0% elongation.

EXAMPLE V 29.32 kg depleted uranium-2 wt % molybdenum alloy, 29.32 kg depleted uranium-0.75 wt % titanium alloy, and 113 grams titanium were placed in a graphite crucible and melted in a vacuum induction furnace. The molten metal was poured into a 7.6 cm cylindrical mold, cooled to room temperature, and removed from the mold. The resulting ingot was placed in a copper can, which was then evacuated and sealed. This billet was then extruded at 700° C. through a 1.8 cm die. The extruded rod was cut into pieces approximately 40 cm in length, which were then ground for removal of the copper can to approximately 1.7 cm diameter. A section of this extruded rod was given a one step outgassing and solutionizing treatment in a vacuum furnace for 2 hours at 850° C., then water quenched. The rod was then given an aging heat treatment in a vacuum furnace for 15.5 hours at 360° C. Tensile properties for the resulting material, having a nominal composition of U-1.0%Mo-0.5%Ti, were measured at 203 ksi tensile yield strength, 267 ksi ultimate tensile strength, and 16.0% elongation.

As a comparison of the properties of the alloy of this invention to those previously used for penetrators, Table I below lists strength and elongation properties of titanium and molybdenum depleted uranium alloys, and Table II the same properties for several examples of the alloys of this invention, illustrating the greatly increased strength and maintenance of elongation exhibited by the alloy of this invention.

TABLE I

| | PRIOR ART | | | |
|---|---|---|---|---|
| Alloy Content | Tensile Yield Strength (ksi) | Ultimate Tensile Strength (ksi) | Elongation (%) | Density (g/cc) |
| U-0.75%Ti | 123 | 165 | 24.0 | 18.6 |
| U-0.75%Ti | 200 | 215 | 2.0 | 18.6 |
| U-2%Mo | 100 | 130 | 25.0 | 18.6 |
| U-2%Mo | 210 | 230 | 1.0 | 18.6 |

TABLE II

| Alloy Content | Tensile Yield Strength (ksi) | Ultimate Tensile Strength (ksi) | Elongation (%) | Density (g/cc) |
|---|---|---|---|---|
| U-0.75%Mo-0.6%Ti-0.15%Zr | 206 | 270 | 9.7 | 18.6 |
| U-1%Mo-0.5%Ti-0.2%Zr (solution treated) | 183 | 260 | 16.0 | 18.5 |
| U-1%Mo-0.5%Ti-0.5%Nb | 213 | 260 | 8.0 | 18.6 |
| U-1%Mo-0.4%Ti-0.25%Zr (TMP) | 213 | 262 | 16.0 | 18.5 |
| U-1%Mo-0.5%Ti | 203 | 267 | 16.0 | 18.7 |
| U-1%Mo-0.5%Ti-0.2%Zr (aged) | 212 | 274 | 10.0 | 18.5 |

(Ksi = thousands of pounds per square inch)
(TMP = combination of mechanical working and thermal processing)

Other embodiments will occur to those skilled in the art and are within the following claims:

What is claimed is:

1. A high strength and ductile depleted uranium alloy comprising approximately 0.75 to 1.50 weight % molybdenum, approximately 0.30 to 0.70 weight % titanium, and depleted uranium.

2. The alloy of claim 1 in which the alloying elements other than depleted uranium make up no more than approximately 2% of the total alloy weight.

3. The alloy of claim 1 further including a third alloying element.

4. The alloy of claim 3 in which the third alloying element is selected from the group consisting of group IVB, VB and VIB elements.

5. The alloy of claim 4 in which the third alloying element makes up approximately 0.05 to 0.5 weight % of the alloy.

6. The alloy of claim 4 in which the third alloying element is zirconium.

7. The alloy of claim 6 in which the zirconium makes up approximately 0.15 to 0.30 weight % of the alloy.

8. The alloy of claim 4 in which the third alloying element is niobium.

9. The alloy of claim 8 in which the niobium makes up no more than approximately 0.5 weight % of the alloy.

10. The alloy of claim 1 in which the alloy has a yield strength of at least approximately 180 ksi.

11. The alloy of claim 1 in which the alloy has a tensile strength of at least approximately 250 ksi.

12. The alloy of claim 1 in which the alloy has an elongation of at least approximately 8%.

13. The alloy of claim 4 in which the group consists of zirconium, hafnium, vanadium, chromium, niobium, tantalum, and tungsten.

14. The alloy of claim 2 in which the alloy density is at least 18 g/cc.

15. A high-strength and ductile depleted uranium alloy comprising: approximately 0.75 to 1.50 weight % molybdenum; approximately 0.30 to 0.70 weight % titanium; approximately 0.05 to 0.5 weight % of an element selected from the group consisting of zirconium, hafnium, vanadium, chromium, niobium, tantalum, tungsten; and depleted uranium.

16. A high-strength and ductile depleted uranium alloy comprising: approximately 0.75 to 1.50 weight % molybdenum; approximately 0.30 to 0.70 weight % titanium; approximately 0.05 to 0.5 weight % of an element selected from the group including consisting zirconium, hafnium, vanadium, chromium, niobium, tantalum, and tungsten; and depleted uranium; in which the alloying elements other than depleted uranium make up no more than approximately 2 weight % of the alloy.

* * * * *